US009334642B1

(12) United States Patent
Tanaka et al.

(10) Patent No.: US 9,334,642 B1
(45) Date of Patent: May 10, 2016

(54) CONNECTION STRUCTURE OF COLUMN AND BEAM, AND REINFORCING MEMBER

(71) Applicant: SENQCIA CORPORATION, Tokyo (JP)

(72) Inventors: Hidenori Tanaka, Funabashi (JP); Taku Tomita, Funabashi (JP)

(73) Assignee: SENQCIA CORPORATION, Tokyo (JP)

( * ) Notice: Subject to any disclaimer, the term of this patent is extended or adjusted under 35 U.S.C. 154(b) by 0 days.

(21) Appl. No.: 14/686,294

(22) Filed: Apr. 14, 2015

(51) Int. Cl.
*E04H 12/18* (2006.01)
*E04B 1/24* (2006.01)

(52) U.S. Cl.
CPC ..... *E04B 1/2403* (2013.01)

(58) Field of Classification Search
CPC ..... E04B 1/1903; E04B 1/2403; E04B 1/185; E04B 2001/2445; E04B 2001/2454; E04B 2001/1957
USPC ..... 403/346, 347
See application file for complete search history.

(56) References Cited

U.S. PATENT DOCUMENTS 1,261,407 A * 4/1918 Lally ..... E04B 1/185 52/283
5,082,166 A * 1/1992 Matsuo ..... B23K 37/06 228/169
6,739,099 B2 * 5/2004 Takeuchi ..... E04B 1/2403 403/403
7,762,038 B2 * 7/2010 Ceba ..... E04B 1/2403 52/653.1
7,874,120 B2 * 1/2011 Ohata ..... E04B 1/2403 52/653.1
2002/0100229 A1 * 8/2002 Chen ..... E04B 1/2403 52/167.1
2003/0041549 A1 * 3/2003 Simmons ..... E04B 1/2403 52/655.1
2006/0144006 A1 * 7/2006 Suzuki ..... E04B 1/2403 52/655.1
2006/0265992 A1 * 11/2006 Hiragaki ..... E04B 1/2403 52/633
2008/0295443 A1 * 12/2008 Simmons ..... E04B 1/24 52/655.1
2011/0047925 A1 * 3/2011 Gan ..... E04B 1/2403 52/653.1
2011/0107711 A1 * 5/2011 Foley ..... E04B 1/2403 52/655.1
2011/0308190 A1 * 12/2011 Pryor ..... E04B 1/2403 52/653.1

FOREIGN PATENT DOCUMENTS

JP 2012-207515 A 10/2012
JP 2013-060752 A 4/2013
JP 2013-174107 A 9/2013
JP 2013-185312 A 9/2013

* cited by examiner

*Primary Examiner* — Brian Mattei
*Assistant Examiner* — Gisele Ford
(74) *Attorney, Agent, or Firm* — Oliff PLC

(57) ABSTRACT

The reinforcing member 13 is an approximately L-shaped member. The reinforcing member 13 comprises a first connecting part 15*a*, which is connected to the connecting surface of the beam 9*b* of the column 5, and a second connecting part 15*b*, which is connected to a surface perpendicular to the surface to which the beam 9*b* is connected. That is, the connecting part 15*a* and the connecting part 15*b* are perpendicular to each other. A concave surface part 17 is provided on the inner surface side of the intersection of the connecting parts 15*a* and 15*b*. The reinforcing member 13 is, for example, made of steel having excellent weldability. On the connecting parts 15*a* and 15*b*, groove parts 19 are formed on the parts corresponding to the welding parts of the column 5.

3 Claims, 9 Drawing Sheets

CONNECTION STRUCTURE OF COLUMN AND BEAM, AND REINFORCING MEMBER

FIELD OF THE INVENTION

The present invention relates to a connection structure of a column and beams and the like for connecting beams having different heights to a steel pipe column.

BACKGROUND OF THE INVENTION

Conventionally, in a construction using a steel pipe column, there is a case in which a beam of H shaped steel is connected. To connect the column and the beam, a through-diaphragm corresponding to the height of a flange part of the beam is provided to transfer stress from the beam to the column efficiently at a connecting part thereof. The through-diaphragm is a plate-like member that is connected by welding and the like between a column and a column. Generally, the flange part of the beam is butted against the side surface of the through-diaphragm to be welded.

However, there are cases in which the sizes (heights) of the beams that are connected to the column are not equal in all directions. For example, there is a case in which a beam having a shorter height is connected in only one direction. In such cases, it is impossible to connect at least one of the upper and lower flanges of the beam to the through-diaphragm to which other beams are connected.

Therefore, to connect such beams having different heights, connecting an inner diaphragm inside the column or the like is necessary.

Also, as a connection structure of column-and-beam to connect beams having different heights, there is a connection structure of column-and-beam wherein, a flange part of a beam is connected to a diaphragm, a beam connection member is connected between the other flange part of the beam and the other diaphragm, and stress is transferred between the beam and the diaphragm via the beam connection member (See Patent Document 1).

PRIOR ART DOCUMENTS

Patent Documents

[Patent Document 1] Japanese Unexamined Patent Application Publication No. 2012-207515 (JP-A-2012-207515)

SUMMARY OF THE INVENTION

Problems to be Solved by the Invention

However, the operation of providing an inner diaphragm in the column requires a large amount of welding and has a problem of poor workability. Also, in the structure described in Patent Document 1, it is impossible to connect the beam connection member if there is not enough space between the beam and the diaphragm.

The present invention was achieved in view of such problems. Its object is to provide a connection structure and the like of a column and beams, wherein the beams having different heights are connected to the column without connecting diaphragms and the like to the inside of the column, which is also applicable even if a gap between the beam and the diaphragm is small.

Means for Solving Problems

To achieve the above object, a first invention provides a connection structure of a column and beams comprising a column having an approximately rectangular cross-sectional outline, a pair of diaphragms formed on the column, a first beam of which flange parts are connected to the upper and the lower diaphragms respectively, a second beam that has a height different to the first beam and is connected to the column in a direction different to the first beam, and a reinforcing member connected to the outer surface of the column, wherein the reinforcing member has a first connecting part and a second connecting part that are formed perpendicular to each other to be approximately L-shaped, a first connecting part being connected to the surface of the column to which the second beam is connected and the second connecting part being connected to the surface which is perpendicular to the surface to which the second beam is connected, a first flange part of the second beam is connected to one of the diaphragms, a second flange part of the second beam is connected to the outer surface of the column, and a pair of the reinforcing member is connected to both sides of the column so as to interpose the second beam. It is preferable that the corner parts of the column are configured with curved surface parts and the inner surface side between the first connecting part and the second connecting part is a concave surface part.

The reinforcing member may have a convex part formed in the direction which is perpendicular to both the forming direction of the first connecting part and the forming direction of the second connecting part, the concave surface part which is continuously formed on the inner surface of the convex part, and at least one of the end part of the second beam in the width direction projecting out to the curved surface part of the column. The reinforcing member may be connected to the column and the second beam with the convex part being inserted into a gap between the curved surface part and the second flange part at the height of the second flange part of the second beam.

The width of the second beam is smaller than the width of the column, and the second beam may be eccentrically connected to the column in its width direction.

The radius of curvature of the concave surface part is preferably smaller than the radius of curvature of the curved surface part.

According to the first invention, the column can be reinforced efficiently against the stress and the like from the beams since the reinforcing member is connected to the column 5 in the vicinity of the connecting part of the beam. Also, since the reinforcing member is connected to the outer part of the column, the work can be done only outside the column. Therefore, the workability of connecting beams to a column is good. Also, the reinforcing member is easily applicable even if the distance between the flange part of the beam and the diaphragm is short since the reinforcing member is connected to both sides of the column to which the beam is connected.

Also, it is possible to transfer the stress from the beam to the column with certainty by inserting the convex part of the reinforcing member into a gap between the side edge part of the flange part of the beam and the corner part (curved surface part) of the column. Such a structure is particularly effective when the beam is connected to the column eccentrically.

Also, no gap may be formed between the tip part of the convex part and the column by making the radius of curvature of the concave surface part of the inner surface of the convex part smaller than the radius of curvature of the curved surface part of the corner part of the column.

A second invention is a reinforcing member used in a connection structure of a column and beams, wherein a first connecting part connected to a first surface of the column and a second connecting part connected to a second surface that is perpendicular to the first surface are formed perpendicular to each other in an approximately L-shape and an inner surface side between the first connecting part and the second connecting part is a concave surface part.

A convex part may be formed in the direction which is perpendicular to both the forming direction of the first connecting part and the forming direction of the second connecting part, and the concave surface part may be continuously formed on the inner surface of the convex part.

The convex parts may be provided in the directions that are opposite to each other in relation to the second connecting part, respectively.

According to the second invention, the vicinity of the connecting part of the column and the beam can be effectively reinforced, and work can be done only outside the column. Therefore, the workability of connecting beams to a column is good.

Also, it is possible to transfer the stress from the beam to the column with certainty since the convex part of the reinforcing member can be inserted into a gap between the side edge part of the flange parts of the beam and the corner part (curved surface part) of the column. Also, by forming such convex parts on both sides, it can be used in either direction.

Effects of the Invention

The present invention can provide a connection structure and the like of a column and beams, wherein the beams having different heights are connected to the column without connecting diaphragms and the like to the inside of the column, which is also applicable even if a gap between the beam and the diaphragm is small.

DETAILED DESCRIPTION OF THE PREFERRED EMBODIMENTS

Figure 1:
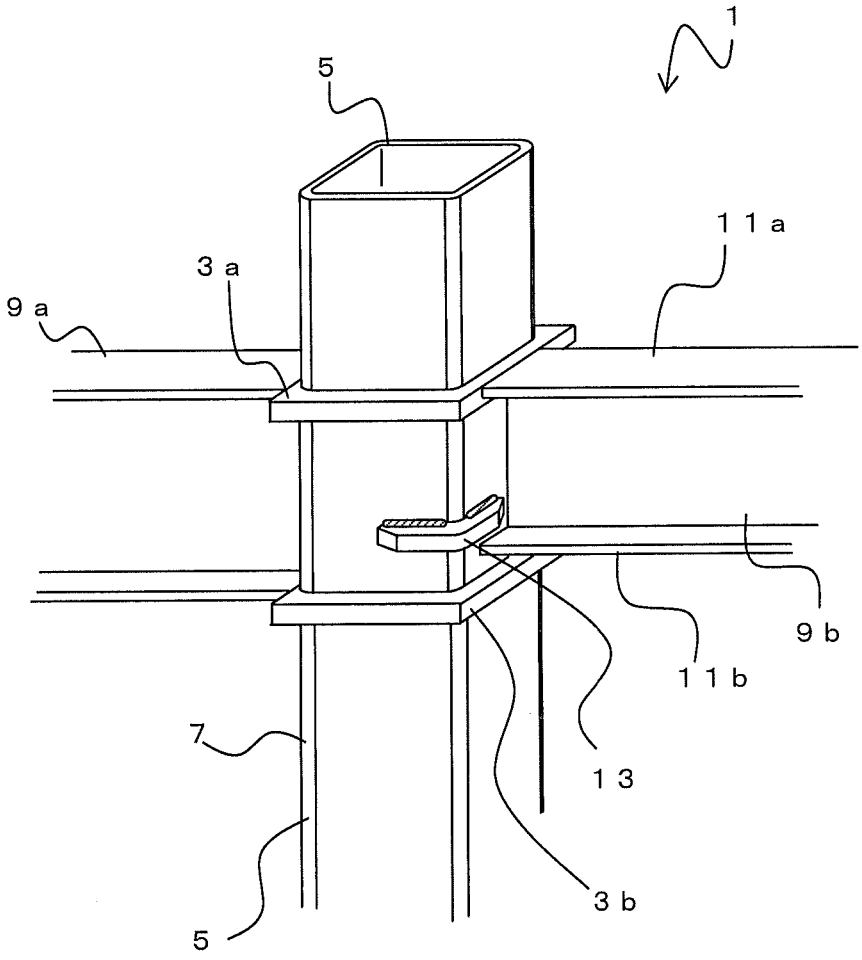
FIG. 1 is a perspective view showing a connection structure 1 of a column and beams.
Figure 2:
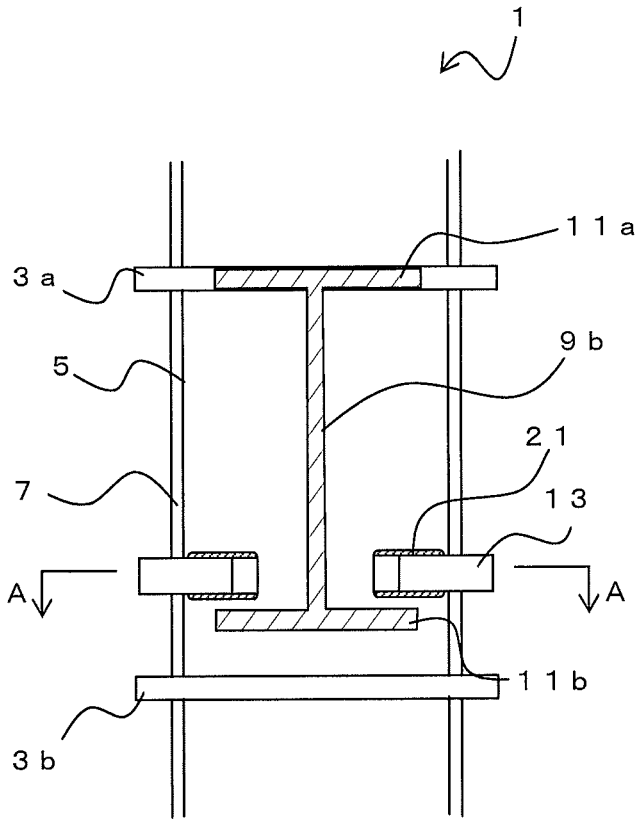
FIG. 2 is an elevated view showing a connection structure 1 of a column and beams.

Hereinafter, a connection structure 1 of a column and beams according to an embodiment of the present invention will be described. FIG. 1 is a perspective view showing a connection structure 1 of a column and beams and FIG. 2 is a diagram viewed from the beam 9*b* side. The connection structure 1 of a column and beams is a structure having a column 5 to which a plurality of beams 9*a* and 9*b* are connected.

The column 5 is a hollow, square-shaped steel piped column of which the cross sectional outline is approximately rectangular. The beams 9*a* and 9*b* are H-shaped steel. The heights of the beams 9*a* and 9*b* are different. Although the example shown in FIG. 1 illustrates that the beam 9*a* is formed on the column 5 in a first direction and the beam 9*b* is formed in a direction opposing the first direction, the present invention is not limited to this case and the beam 9*a* or the beam 9*b* may be provided in a plurality of directions.

A pair of diaphragms 3*a* and 3*b* is connected to the column 5. The diaphragms 3*a* and 3*b* are through diaphragms protruding outwardly from the column 5. The diaphragms 3*a* and 3*b* are provided on the upper and lower parts of the column 5 with a predetermined interval.

The edge parts of the upper and lower flange parts of the beam 9*a*, which is a first beam, are connected to the diaphragm 3*a* and 3*b* by welding respectively. That is, the installation interval between the diaphragms 3*a* and 3*b* is equal to the flange interval of the beam 9*a*. Therefore, stress from the beam 9*a* can be transferred to the column with certainty.

The edge part of an upper flange part 11*a* of the beam 9*b*, which is a second beam, is connected to the upper diaphragm 3*a* by welding. Since the height of the beam 9*b* is shorter than the height of the beam 9*a*, a gap is generated between a lower flange part 11*b* of the beam 9*b* and the diaphragm 3*b*. Therefore, the flange part 11*b* is connected to the outer surface of the column 5.

A reinforcing member 13 is connected to the outer surfaces of the column 5 on both sides of the beam 9*b* where the reinforcing member 13 does not interfere with the flange part 11*b* of the beam 9*b*. For example, the reinforcing member 13 is connected to a position slightly above the flange part 11*b* of the beam 9*b*. The reinforcing member 13 is an approximately L-shaped member and connected to the outer surfaces of the column 5. That is, the reinforcing member 13 is connected to the column 5 straddling the surface to which the beam 9*b* is connected and the other surface which is perpendicular thereto.

Figure 3:
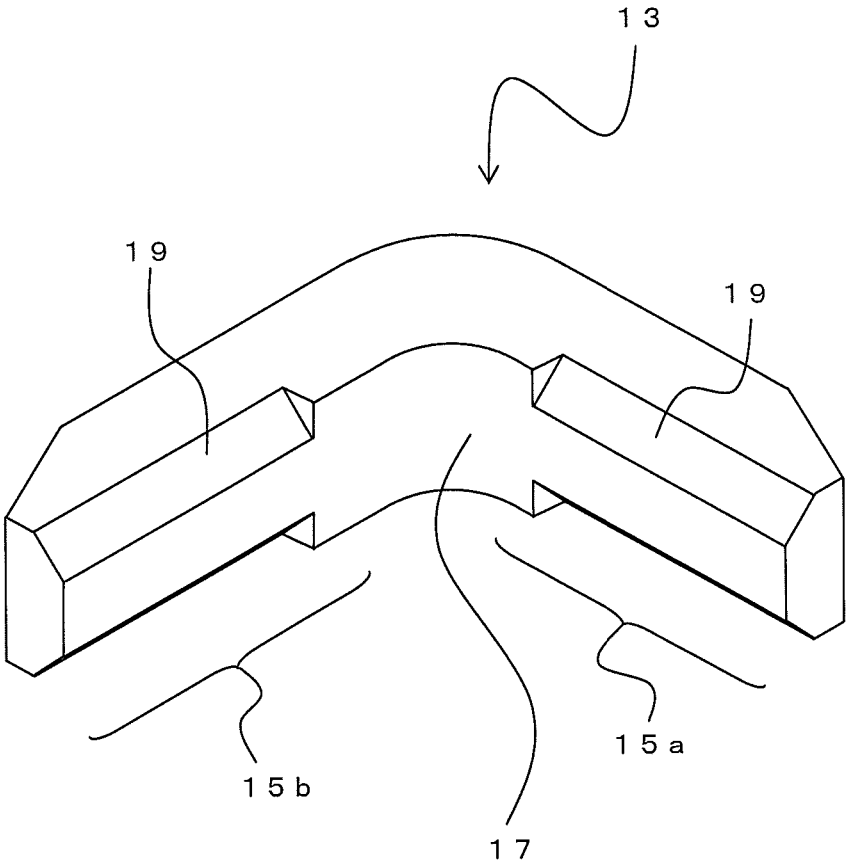
FIG. 3 is a perspective view showing a reinforcing member 13.

FIG. 3 is a perspective view showing the reinforcing member 13. As mentioned above, the reinforcing member 13 is an approximately L-shaped member. The reinforcing member comprises a first connecting part 15*a*, which is connected to the connecting surface of the beam 9*b*, and a second connecting part 15*b*, which is connected to a surface perpendicular to the surface to which the beam 9*b* is connected. That is, the connecting part 15*a* and the connecting part 15*b* are perpendicular to each other. A concave surface part 17 is provided on the inner surface side of the intersection of the connecting parts 15*a* and 15*b*.

The reinforcing member 13 is, for example, made of steel having excellent weldability. On the connecting parts 15*a* and 15*b*, groove parts 19 are formed on the parts corresponding to the welding parts of the column 5 (welding parts 21 in FIG. 2).

Figure 4:
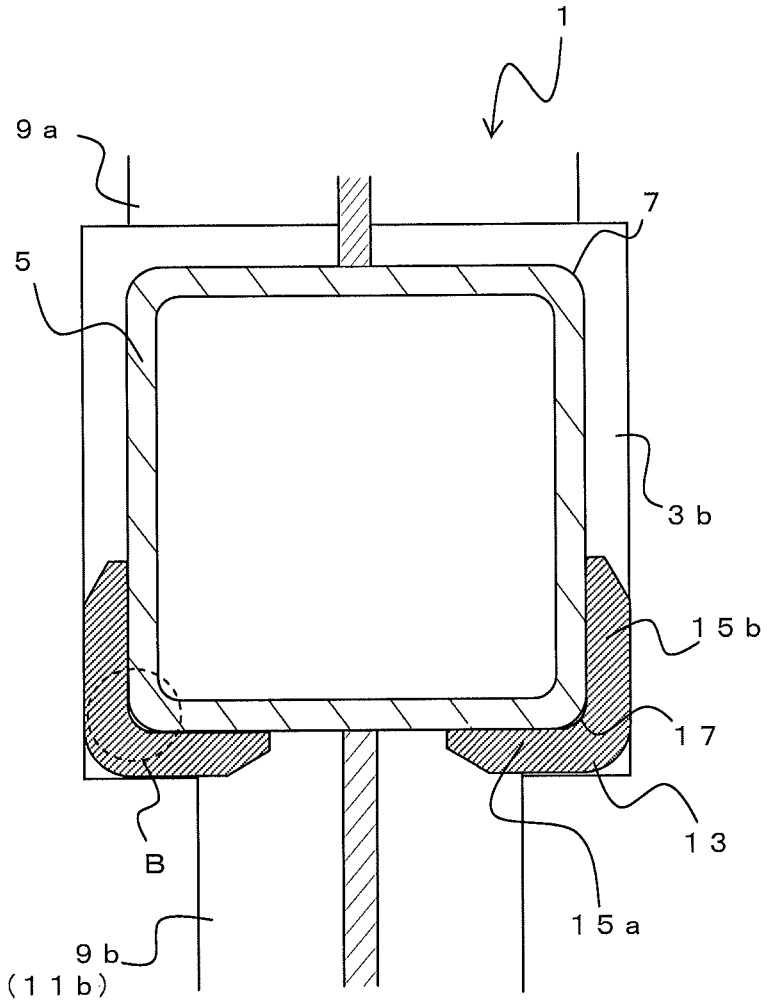
FIG. 4 is a cross-sectional view of A-A line in FIG. 2 showing connection structure 1 of a column and beams.

FIG. 4 is a cross-sectional view of A-A line in FIG. 1. As shown in FIG. 4, the reinforcing member 13 is connected to the surfaces of the column 5 with the connecting parts 15*a* and 15*b*. At this time, the connecting parts 15*a* and 15*b* are connected to both sides of the beam 9*b* respectively as if interposing the beam 9*b*. At this time, the connecting part 15*a* is connected to the surface of the column 5 to which the beam 9*b* is connected and the connecting part 15*b* is connected to the surface of the column 5 that is perpendicular to the surface to which the beam 9*b* is connected.

The thickness of the reinforcing member 13 is approximately equal to the protrusion margin of the diaphragm 3*b* in relation to the column 5. Therefore, as shown in FIG. 4, the reinforcing member 13 is disposed so that the reinforcing member 13 is within the projected area of the diaphragm 3*b* in a plan view. If necessary, backing metal, which is omitted in the drawing, may be used at each welding part.

Figure 5:
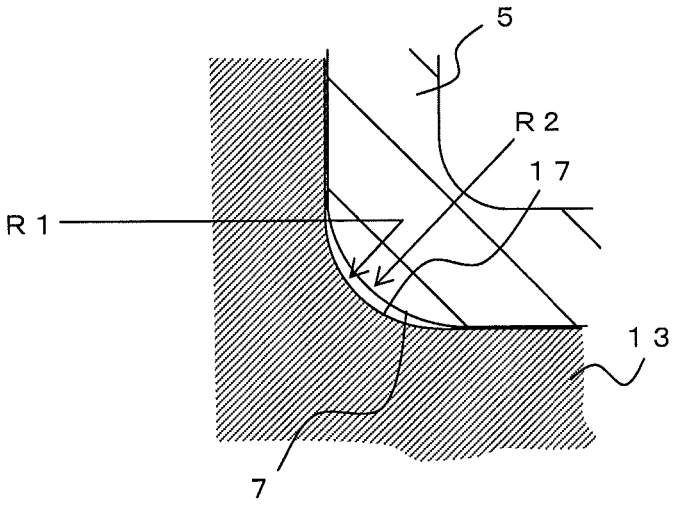
FIG. 5 is an enlarged view of part B in FIG. 4, showing an enlarged view of the vicinity of a curved surface part 7 of a column 5.

FIG. 5 is an enlarged view of B part in FIG. 4. The concave surface part 17 of the inner part surface of the reinforcing member 13 is disposed opposing to the curved surface part 7. Here, the shape of the concave surface part 17 of the inner part surface of the reinforcing member 13 corresponds to the curved surface part 7 of the column 5, and its radius of curvature R1 is slightly smaller than the radius of curvature R2 of the curved surface part 7 of the column 5. This is because the reinforcing member 13 does not come into contact with the column 5 if R1 is larger than R2. Therefore, there may be a small gap formed between the concave surface part 17 and the curved surface part 7.

Thus, providing the reinforcing member 13 on the vicinity of the connecting part of the flange part 11*b* of the beam 9*b*, which is an outer surface of the column 5, can reinforce the column 5 with certainty against forces given to the column 5, such as tension or compressive stress from the beam 9*b* and the moment originating from the connecting part with the diaphragm 3*a*. Also, the column 5 can be reinforced with certainty even if the distance between the beam 9*b* (the flange part 11*b*) and the diaphragm 3*b* is small.

Although an example in which the height of the beam 9*b* is shorter than the height of the beam 9*a* is described in this embodiment, the present invention is applicable to a case in which the beam 9*b* is higher than the beam 9*a*. In this case, a predetermined range of the web of the beam 9*b* is cut and the reinforcing member 13 is connected to the column 5 and the lower surface part and the like of the diaphragm 3*b*.

Also, the beam 9*b* and the reinforcing member 13 may be connected in an upside down state of FIG. 2. In this case, the reinforcing member 13 may be provided, not on the upper part, but on the lower part of the flange part 11*b*.

Next, another variation of the reinforcing member 13 will be described. The same numerals from FIG. 1 to FIG. 5 will be used to show the elements having the similar functions of the reinforcing member 13 and the connection structure 1 of a column and beams using the same, and redundant explanations will be omitted.

Figure 6:
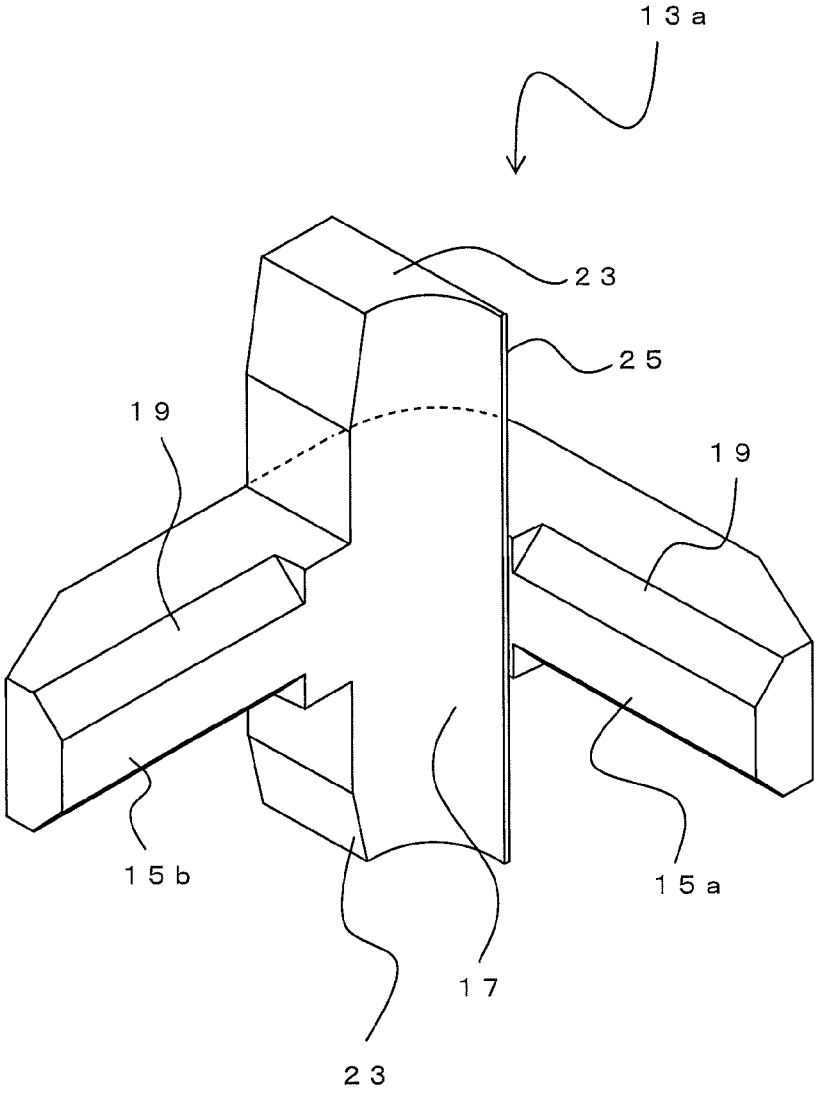
FIG. 6 is a perspective view showing a reinforcing member 13*a*.

FIG. 6 is a perspective view showing a reinforcing member 13*a*. The reinforcing member 13*a* has approximately the same structure as the reinforcing member 13 except for convex parts 23 formed (in both directions that are approximately perpendicular to both the connecting parts 15*a* and 15*b* of the reinforcing member 13*a*). That is, while the reinforcing member 13 is approximately L-shaped, the reinforcing member 13*a* has the convex parts 23 protruding both upwardly and downwardly. The width and the thickness of the connecting parts 15*a* and 15*b*, the radius of curvature of the concave surface part 17, and the like are the same as those of the reinforcing member 13.

The concave surface part 17, which is provided on the inner surface of the connecting parts 15*a* and 15*b*, is continuously formed on the inner surface of the convex parts 23. That is, the reinforcing member 13*a* has the concave surface part 17 extending upward and downward with a fixed curvature. Therefore, a concave surface edge part 25, which is a tip of a region of the concave surface part 17 protruding from the connecting parts 15*a* and 15*b*, has a cross sectional shape which is tapered toward the tip. The convex parts 23 are provided on the upper and lower surfaces of the connecting part 15*b* respectively in the directions that are opposite to each other and the concave surface edge part 25 is formed to face the side of the connecting part 15*a*.

Figure 7:
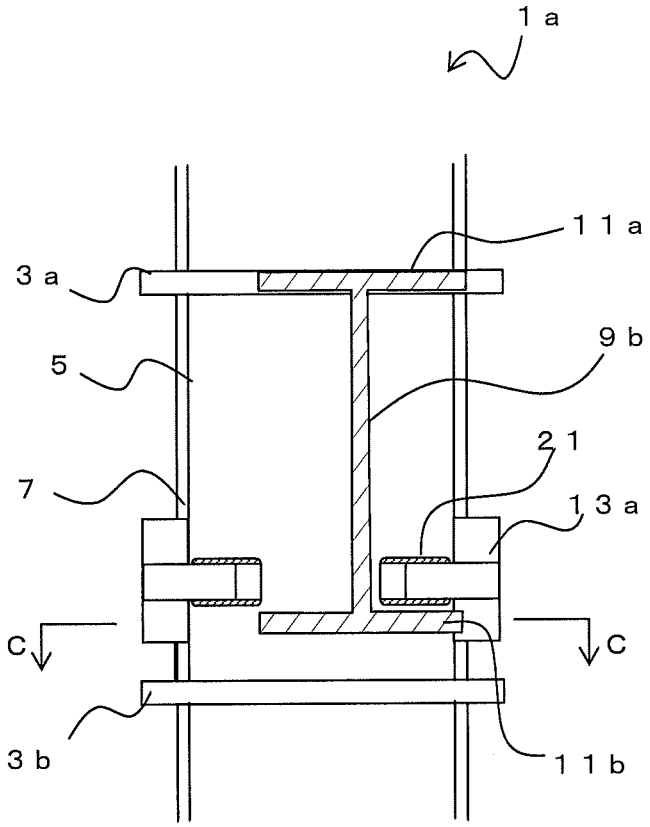
FIG. 7 is an elevated view showing a connection structure 1*a* of a column and beams.
Figure 8:
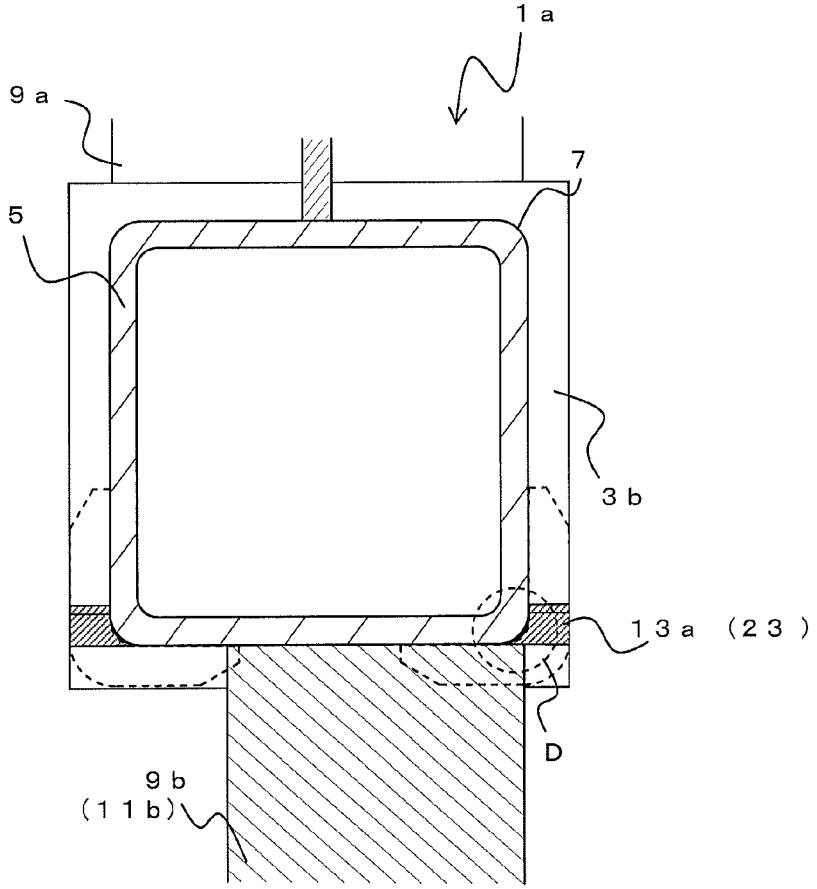
FIG. 8 is a cross-sectional view of C-C line in FIG. 7 showing a connection structure 1*a* of a column and beams.

FIG. 7 shows a connection structure 1*a* of a column and beams using the reinforcing member 13*a* instead of the reinforcing member 13 (the diagram corresponds to FIG. 2). FIG. 8 is a cross-sectional view of C-C line in FIG. 7. The reinforcing member 13*a* is connected to the outer surface of the column 5 substantially similarly to the reinforcing member 13*b* except that the connecting position of the beam 9*b* is different from the connection structure 1 of a column and beams.

In the connection structure 1*a* of a column and beams, the beam 9*b* is disposed eccentrically in the width direction of the column 5. That is, the beam 9*b* is disposed eccentrically to the column 5 so that one side of the column 5 (on the right in the diagram) coincides with one side (on the right in the diagram) of the beam 9*b* (flange part 11*b*).

The convex parts 23 formed on the reinforcing member 13*a* are disposed toward the longitudinal direction of the column 5. That is, the convex parts 23 are disposed along the corner part (the curved surface part 7) of the column 5.

Figure 9:
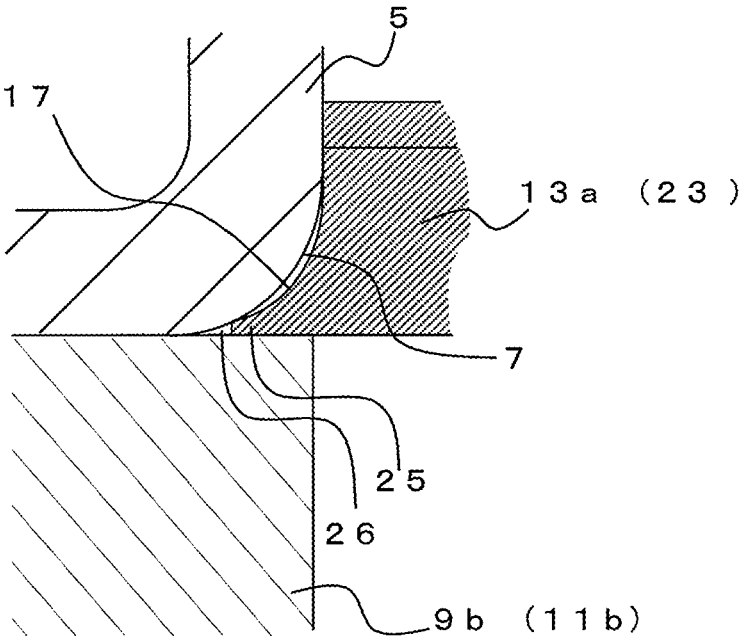
FIG. 9 is an enlarged view of part D in FIG. 8, showing an enlarged view of the vicinity of the curved surface part 7 of the column 5.

FIG. 9 is an enlarged view of D part in FIG. 8. As mentioned above, the curved surface part 7 is provided on the corner part of the column 5. Thereby, if the side surface of the column 5 and the side edge part of the beam 9*b* are put together, a gap 26 is formed between the edge part of the beam 9*b* (flange part 11*b*) and the curved surface part 7 of the column 5. That is, one of the edge parts of the flange part 11*b* in its width direction projects out to the curved surface part 7 of the column 5. The concave surface edge part 25 of the convex part 23 is inserted into this gap 26.

At this time, since the radius of curvature of the concave surface part 17 is smaller than the radius of curvature of the curved surface part 7, there is no gap formed between the reinforcing member 13*a* and the column 5. The convex parts 23 are welded and connected with the column 5 and the flange part 11*b* in this state.

The height of the convex part 23 (the protruding margin from the connecting part 15*b*) is determined taking the distance from the position in which the connecting parts 15*a* and 15*b* are connected and the thickness of the flange part 11*b* into consideration. That is, the height of the convex part 23 is determined so that the convex part 23 can cover the whole thickness of the flange part 11*b* when the reinforcing member 13*a* is connected to the column 5.

According to the second embodiment, similar effects as the first embodiment can be obtained. Also, in the case in which the beam 9*b* is eccentrically connected, the gap 26 between the curved surface part 7 at the corner part of the column 5 and the flange part 11*b* is filled with the convex part 23 (the concave surface edge part 25) and hence it is possible to transfer the stress with certainty between the beam 9*b* and the column 5 at this part.

Although the convex parts 23 are provided on both sides of the reinforcing member 13*a*, one convex part 23 may be provided only on either side. However, by forming the convex parts 23 on both sides, the reinforcing member 13*a* can be used in reversed position so that the same component can be used independent of the eccentric direction of the beam 9*b*. Therefore, it is unnecessary to manufacture and manage two types of reinforcing members.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

For example, although the curved surface part 7 is formed on the corner part of the column 5 and the concave surface part 17 is formed on the reinforcing member 13 or 13*a* in the examples shown in the above-mentioned embodiments, the present invention is not limited to these examples. Each of the plane surfaces of the connecting parts 15*a* and 15*b* may be formed to be orthogonal to each other and, in this case, the corner part of the column 5 may also have the plane surfaces that are orthogonal to each other without forming the curved surface part 7.

EXPLANATION OF NUMERALS

1, 1*a* . . . connection structure of a column and beams
3*a*, 3*b* . . . diaphragm
5 . . . column
7 . . . curved surface part
9*a*, 9*b* . . . beam
11*a*, 11*b* . . . flange part
13, 13*a* . . . reinforcing member
15*a*, 15*b* . . . connecting part
17 . . . concave surface part
19 . . . groove part
21 . . . welding part
23 . . . convex part
25 . . . concave surface edge part
26 . . . gap

What is claimed is:

1. A connection structure of a column and beams comprising:

a column having an approximately rectangular cross-sectional outline;

a pair of diaphragms formed on the column;

a first beam of which flange parts are connected to an upper diaphragm and a lower diaphragm of the diaphragms respectively;

a second beam that has a height different to the first beam and is connected to the column in a direction different to the first beam; and a reinforcing member connected to outer surfaces of the column, wherein the reinforcing member has a first connecting part and a second connecting part that are formed perpendicular to each other to be approximately L-shaped, the first connecting part being connected to a surface of the column to which the second beam is connected and the second connecting part being connected to a surface which is perpendicular to the surface to which the second beam is connected;

a first flange part of the second beam is connected to one of the diaphragms;

a second flange part of the second beam is connected to an outer surface of the column;

a pair of the reinforcing member is connected to both sides of the column so as to interpose the second beam, corner parts of the column are configured with curved surface parts;

an inner surface side between the first connecting part and the second connecting part is a concave surface part;

the reinforcing member has a convex part which is the component of the reinforcement member which protrudes from both an upper surface and a lower surface of the reinforcement member in a direction perpendicular to both a longitudinal direction of the first connecting part and a longitudinal direction of the second connecting part;

the concave surface part is continuously formed on an inner surface of the convex part;

at least one of the end parts of the second beam in its width direction projects out to the curved surface part of the column; and the reinforcing member is connected to the column and the second beam with the convex part being inserted into a gap which is formed between the curved surface part and the second flange part at a height of the second flange part of the second beam when a side surface of the column and a side edge part of the second beam are put together and one of edge parts of the second flange part in its width direction projects out to the curved surface part.

2. A reinforcing member used in a connection structure of a column and beams wherein, a first connecting part connected to a first surface of the column and a second connecting part connected to a second surface that is perpendicular to the first surface are formed perpendicular to each other in an approximately L-shape;

an inner surface side between the first connecting part and the second connecting part is a concave surface part;

a convex part which is the component of the reinforcement member which protrudes from both an upper surface and a lower surface of the reinforcement member in a direction perpendicular to both a longitudinal direction of the first connecting part and a longitudinal direction of the second connecting part is formed; and the concave surface part is continuously formed on an inner surface of the convex part.

3. The reinforcing member according to claim 2 wherein, the convex parts are provided in directions that are opposite to each other in relation to the second connecting part, respectively.

* * * * *